United States Patent [19]

James

[11] Patent Number: 4,973,006

[45] Date of Patent: Nov. 27, 1990

[54] TRAP GUIDE PROCESS FOR HIGH SPEED SPINNING

[76] Inventor: Billy R. James, Route 3, Box 307, Clyde, N.C. 28721

[21] Appl. No.: 468,398

[22] Filed: Jan. 22, 1990

[51] Int. Cl.[5] ..... B65H 54/20; B65H 57/00

[52] U.S. Cl. ..... 242/35.5 OR; 242/42; 242/18 R; 242/18 PW; 242/157 R

[58] Field of Search ..... 242/35.5 R, 18 G, 18 R, 242/42, 157 R, 18 PW; 28/199, 212

[56] References Cited

U.S. PATENT DOCUMENTS

| | | | |
|---|---|---|---|
| 2,092,811 | 9/1937 | Moncrieff et al. | 242/42 |
| 3,371,877 | 3/1968 | Klink et al. | 242/18 G |
| 3,414,956 | 12/1968 | Genson | 242/18 G |
| 3,653,860 | 4/1972 | Smith et al. | 242/18 G |
| 3,814,341 | 6/1974 | Dickson, III et al. | 242/35.5 R |
| 3,901,455 | 8/1975 | Carlisle | 242/18 G |
| 4,130,248 | 12/1978 | Hendrix et al. | 242/18 G |
| 4,206,883 | 6/1980 | Isoard | 242/18 G |
| 4,421,282 | 12/1983 | McKinney, III | 242/18 G |
| 4,657,205 | 4/1987 | Sugioka | 242/35.5 R |
| 4,693,429 | 9/1987 | Billard et al. | 242/18 G |

*Primary Examiner*—Stanley N. Gilreath

[57] ABSTRACT

A trap guide process for high speed spinning are described in which a pivotable guide rod is utilized across the face of a multiplicity of finger-like rods. The finger-like rods are used to separate the separate ends or groups of filaments in a multiple-end spinning operation.

6 Claims, 1 Drawing Sheet

TRAP GUIDE PROCESS FOR HIGH SPEED SPINNING

BACKGROUND OF THE INVENTION

In the manufacture of textile filaments of yarns from meltspun polymers, especially for the finer textile deniers, it is useful to wind a number of separate packages or rolls of filaments simultaneously from the same polymer extrusion source. Aside from an increase in the rate of production of textile filaments, the increased polymer usage aids in controlling the time a polymer is at high temperature spinning conditions.

For substantially the same reason, spinnerettes, or spinning orifices for spinning polymer into conditions where it forms filaments, are grouped closely together. It follows that winding of the separate groups of filaments will be done in a compact manner. Often, the same winding rotor will be used to wind a number of "packages" of yarn simultaneously—"in-line", so to speak.

In high speed spinning, particularly at speeds above 2500 meters per minute, "threading in" of two or more filament packages creates conditions which can be difficult. "Threading" is the process of capturing yarn from a spinnerette and directing it through processing conditions ultimately ending in placing the filaments on a winding arbor for takeup into package form. Threading is simplified somewhat by use of at least one and usually two means for taking yarn to a waste collection device—aspirators. One waste aspirator is usually mounted on the machine; another is mounted at the end of a flexible tube. Individual ends of textile filaments or yarn are extruded through the spinnerettes and brought down to the machine aspirator and sent to waste until all ends associated with a particular winding arbor or rotor are spinning satisfactorily. Depending upon the winding process, one or more intermediate godets or rolls may be involved, but the type of process is not relevant to this invention.

Where all ends have been "spun in" satisfactorily, the winding arbor is brought to speed. Individual ends are brought from the machine aspirator via the tube aspirator "gun" to a winding position on the arbor, the spinning end is transferred to the rotating arbor and begins the formation of a package. Obviously, all ends being spun simultaneously, the ends have to be strung quickly and efficiently, else substantial material will be lost. It is not unusual for just the slightest movement or drag against the filaments moving so closely together to cause them to intermingle with adjacent filaments and create yarn breaks or loose ends or both. Historically, at least two operators have been necessary during threading to keep the ends separated and to properly wind them within the short term allotted to startup. This invention eliminates the need for more than one operator and simplifies separation of the yarns during startup to avoid yarn breaks or loose ends.

BRIEF DESCRIPTION OF THE INVENTION

This invention involves a trap guide for use in high speed spinning of multiple ends of filaments. The trap guide of this invention involves a plate mounted to the face of a fiber melt-spinning machine, the plate having a multiplicity of finger-like rods extending outwardly from the face of the plate in an orderly sequence. The rods may be straight across or may be positioned in a downward slant or in a "V" slanted configuration. The face plate has a bracket attached extending outwardly and parallel to the finger rods and a guide rod of sufficient length to extend substantially across the face of the plate and the finger rods. The guide rod is pivotally attached to the bracket.

In operation the guide rod can be pivoted out of the way to remove or insert individual yarn ends as necessary. A fixed back guide may be located on the face of the plate to arrest rearward movement of yarn ends in a plane parallel to the machine face.

The movable or pivoting guide rod positioned in front of the fixed back guide prevents yarn ends from looping over the end of the guide rods or fingers in their downward movement from the spinning orifices to the remainder of the processing of the spinning machine.

The process involves a threading in of a multiplicity of ends of filaments in a high speed spinning operation of greater than 2500 m/min utilizing the trap guide described above, a stationary waste aspirator and removable waste filament aspirator comprising the steps of pivoting, if necessary, the guide rod from across the face of the guide plate; capturing a first group of filaments with the movable aspirator and guiding the group of filaments between a first set of finger rods; and directing the captured group to the fixed aspirator. This capturing step is repeated until all groups of the filaments have been threaded through the guide and captured by the fixed aspirator. The first group of filaments is then captured and removed from the fixed aspirator using the movable aspirator and thereafter threaded through the remaining elements of the spinning process ultimately to a winding arbor. The pivotable guide rod can be placed in position to prevent the string of filaments as necessary during the threading up process of this first and then the remaining threadlines in sequence.

DETAILED DESCRIPTION OF THE INVENTION

Figure 1:
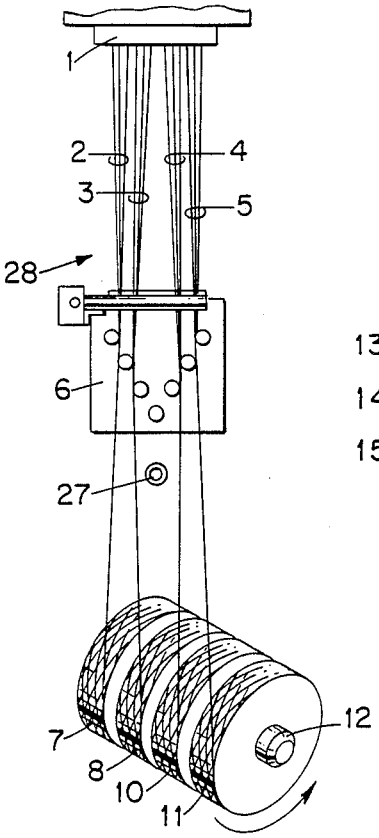
FIG. 1 is a schematic view of a typical spin winding process in which four groups of textile yarn are being wound simultaneously on a single arbor.

In FIG. 1, a simplified process for manufacturing multiple ends (2, 3, 4, and 5) of yarn spun simultaneously from a spinnerette 1 are separated through the fingers of a guide 6 to separate the yarn ends as they are fed to separate packages 7, 8, 10 and 11 being formed on a rotating arbor 12.

Figure 2:
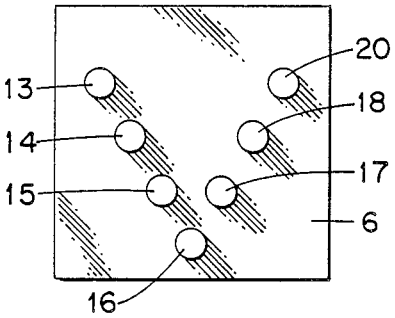
FIG. 2 shows the face view of a spinning guide for separating individual ends of textile filaments.
Figure 2A:
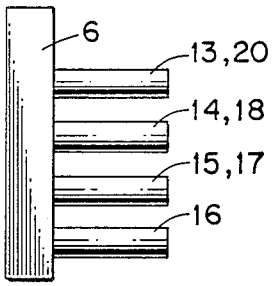
FIG. 2A is a side view of FIG. 2.

As shown in FIGS. 2 and 2A, the guide rods or fingers 13, 14, 15, 16, 17, 18 and 20 extend perpendicularly from mounting plate 6 to a distance sufficient to segregate ends of filaments projecting downwardly from the spinnerette assembly 1. An aspirator 27 may be mounted in the machine face 28 to temporarily collect surplus or waste yarn ends during startup or a break of one or more of the yarn filaments.

FIG. 2 illustrates a preferred orientation of the guide rods. In the orientation shown, an odd number of rods extend outwardly from the face of mounting plate 6. A first rod 16 is mounted in the lower quadrant of the face and substantially halfway across the face. Remaining finger rods 13, 14, 15, 17, 18 and 20 are mounted in groups of two, each group of two being mounted about a rod diameter above and outside the preceding group. For example, rods 15 and 17 form one group. These rods are mounted above and outside first rod 16. Rods 14 and 18 form a second group. Rods 14 and 18 are mounted above and outside rods 15 and 17, respectively. In this manner, the rods are positioned to form a separate vertical path for the groups of filaments therebetween.

Figure 3:
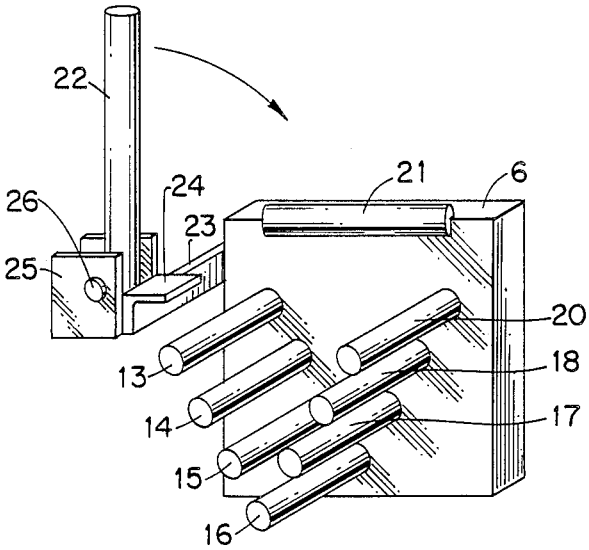
FIG. 3 is an oblique three-dimensional view of the guide of this invention showing the front trap guide in open position.
Figure 3A:
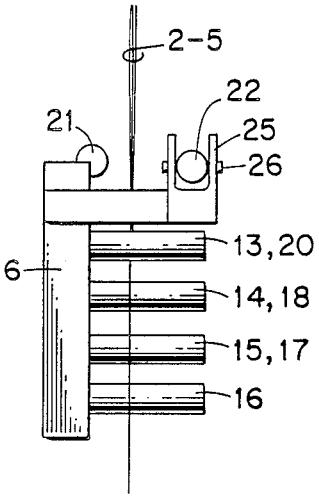
FIG. 3A is a side view of FIG. 3 with the front trap guide in closed position.

In FIG. 3 and FIG. 3A, the guide face 6 and separate fingers 13–20 are shown as in FIGS. 2 and 2A. A back guide rod 21 is mounted to plate 6 and provides a stop for rearward movement of the yarn groups 2–5. Bracket 23 extends forward from face 6 parallel to the guide fingers.

A pivot support 25 is mounted to bracket 23 and front guide rod 22 is pivotally mounted to support 25 by dowel 26. Tab stop 24 provides a rest for front guide rod 22 as it rotates approximately 90° clockwise from its depicted upward location. In its rotated position (FIG. 3A), rod 22 prevents yarns 2–5 from moving forward off the guide fingers.

In operation, rod 22 is rotated to its upper position (FIG. 3) and each of the groups of textile yarn 2–5 are positioned between their respective fingers -i.e., group 2 is positioned between fingers 13 and 14, group 3 between fingers 14 and 15, etc. Rod 22 may be moved from an upper position away from the finger rods to a rotated position blocking the finger rods after each group is separately threaded in. The yarn groups so captured stay positioned within the finger rods and are not permitted to stray into adjacent yarn groups where they may become entangled. In this manner a single operator may conveniently and efficiently sequentially thread in a complete spinning position in short order and without need for future assistance.

I claim:

1. A trap guide for use in high speed spinning of multiple ends of filaments: comprising a face plate; a multiplicity of finger rods extending outwardly from the face of said plate in orderly sequence; a bracket fixedly attached to said plate substantially parallel and outside said multiplicity of finger rods; a pivot support mounted on said bracket out from said plate face less than the length of said finger rods; a guide rod of length to extend substantially across the face of said plate and finger rods; and means attached to said pivot support for pivoting said guide rod about one end of said rod.

2. The trap guide of claim 1, wherein said means for pivoting said guide rod include a tab mounted to said bracket extending toward but not to said finger rods, and dowel means extending through said pivot support and said one end of said guide rod substantially one half the guide rod thickness above said tab.

3. The trap guide of claim 2, including means for stopping upward pivot movement of said guide rod after the pivot movement of said rod has cleared said multiplicity of rods.

4. The trap guide of claim 1, including a fixed guide means mounted to the face of said plate.

5. The trap guide of claim 1, wherein said multiplicity of rods extending outwardly from said face are odd in number, a first finger rod being mounted substantially halfway across said face in the lower quadrant of the face, the remaining finger rods being mounted in groups of two, each group being mounted about a rod diameter above and outside the preceding group, the positioning of the finger rods being in a manner to form a separate vertical path for groups of filaments therebetween.

6. A process for threading in a multiplicity of ends of filaments from a high speed spinning operation greater than 2500 meters per minute utilizing the trap guide of claim 1, a stationary waste filament aspirator and a movable waste filament aspirator, comprising the steps of:

(a) pivoting, if necessary, said guide rod from across the face of said plate;

(b) capturing a first group of filaments with said movable aspirator and guiding the group of filaments between a first set of finger rods and directing the first group to the fixed aspirator;

(c) repeating step (b) with each group of filaments, placing each succeeding group in adjacent sets of finger rods;

(d) capturing the first group of filaments with said movable aspirator, removing the first group from said fixed aspirator;

(e) rotating said guide rod across the face of said plate to trap the remaining ends of filaments;

(f) threading said first group of filaments through the remaining elements of the process ultimately to a winding arbor;

(g) rotating said guide rod from across the face of said plate and repeating sequentially steps (d), (e), and (f) with each succeeding group of filaments.

* * * * *